United States Patent [19]

Farrens et al.

[11] Patent Number: 4,605,149

[45] Date of Patent: Aug. 12, 1986

[54] STAPLING MACHINE

[75] Inventors: Eldon F. Farrens, Imperial Beach, Calif.; Arthur M. Tillery, 4602 Katy Ct., La Mesa, Calif. 92041

[73] Assignees: Arthur M. Tillery; Elinor E. Tillery, both of National City, Calif.

[21] Appl. No.: 725,218

[22] Filed: Apr. 19, 1985

[51] Int. Cl.[4] ..... B27F 7/09; B27F 7/34; B27F 17/28

[52] U.S. Cl. ..... 227/7; 227/3; 227/111

[58] Field of Search ..... 227/3, 7, 111

[56] References Cited

U.S. PATENT DOCUMENTS

| | | | |
|---|---|---|---|
| 2,489,207 | 11/1949 | Tubbs | 227/7 |
| 2,569,355 | 9/1951 | Tubbs | 227/7 |
| 2,915,754 | 12/1959 | Wandel | 227/7 X |
| 3,984,040 | 10/1976 | Fry | 227/7 |
| 4,224,731 | 9/1980 | Lingle | 227/7 X |
| 4,265,387 | 5/1981 | Strouse | 227/7 |

*Primary Examiner*—Paul A. Bell
*Attorney, Agent, or Firm*—Brown, Martin & Haller

[57] ABSTRACT

A machine for automatically driving object such as staples into a rod at substantially equally spaced intervals comprises a stapling device for driving staples into the rod, a driving assembly for moving the rod past the stapling device, and an indexing wheel contacting the rod so as to be driven to rotate by movement of the rod. A series of spaced switch activators such as pins on the wheel are positioned to operate one or more switches each time they rotate into contact with a switch. The activator for each switch is arranged to control operation of the stapling device, so that a staple is driven into the rod each time the switch is activated and a series of staples are driven into the rod at spacings controlled by the switch activator spacings. Where there is more than one switch corresponding to different staple spacings, a switch selector is provided to select any one of the switches for controlling the stapling device.

9 Claims, 6 Drawing Figures

STAPLING MACHINE

BACKGROUND OF THE INVENTION

The present invention relates to a machine for driving objects such as staples, pins, hooks and the like into rods at spaced intervals.

Wooden venetian blinds generally comprise a series of horizontal slats controlled by vertical rods to which the slats are pivoted so that they can be rotated between their open and closed orientations. The connection between the slats and the rods is made by interconnecting pairs of staples. Thus in making the blinds it is necessary to drive staples into the rods at equally spaced intervals corresponding to the desired slat spacing. Successive slats in the blinds have staples arranged for pivotal engagement with successive staples in the rod. The operation of applying a row of staples to such rods has been done in the past by hand using a staple gun. The manual insertion of staples is time consuming and tedious, and does not give sufficient accuracy in the staple spacing, causing considerable problems when the blinds are assembled together. In some cases the blinds have to be taken apart and the rods re-stapled when the uneven spacing is too extreme.

SUMMARY OF THE INVENTION

According to the present invention a machine for automatically driving objects such as staples into a rod at spaced intervals is provided. The machine in a preferred embodiment of the invention includes a stapling device for driving staples into the rod and a driving device for moving the rod past the stapling device. A rotatable indexing device contacts the rod so as to be driven to rotate by movement of the rod. A series of switch actuators are mounted at spaced intervals on the indexing device and at least one switch is positioned to be actuated each time one of the actuators moves past it. The switch controls operation of the stapling device to drive a staple into the rod each time an actuator moves past the switch. Thus, by suitable spacing of the actuators, the spacing between staples driven into the rod can be controlled, since rotational movement of the indexing device will be proportional to the linear movement of the rod.

In the preferred embodiment of the invention, the indexing device comprises a wheel contacting the edge of the rod and the actuators comprise a series of pins projecting upwardly and/or downwardly from the wheel. The pins are arranged to control actuation of one or more microswitches. Separate series of different height pins at different spacings may be arranged to operate different microswitches, so that various different staple spacings may be chosen by selection of which particular microswitch operates the stapling device.

Although in the preferred embodiment staples are driven into the rod at spaced intervals, the machine may clearly be arranged to drive any desired objects having a point or points into a rod at equally spaced intervals, such as hooks, pins, and the like, with the switch or switches controlling operation of a suitable device for driving the objects into the rod.

It is an advantage of the present invention that a machine is provided which automatically drives objects such as staples into a rod at substantially equally spaced intervals.

It is a further advantage of the invention that time is saved and a more uniform spacing is achieved.

BRIEF DESCRIPTION OF THE DRAWINGS

These and other objects and advantages of the present invention will become clear from the following description of a preferred embodiment of the invention, taken in conjunction with the accompanying drawings in which like reference numerals refer to like parts and in which.

DESCRIPTION OF PREFERRED EMBODIMENT

Figure 1:
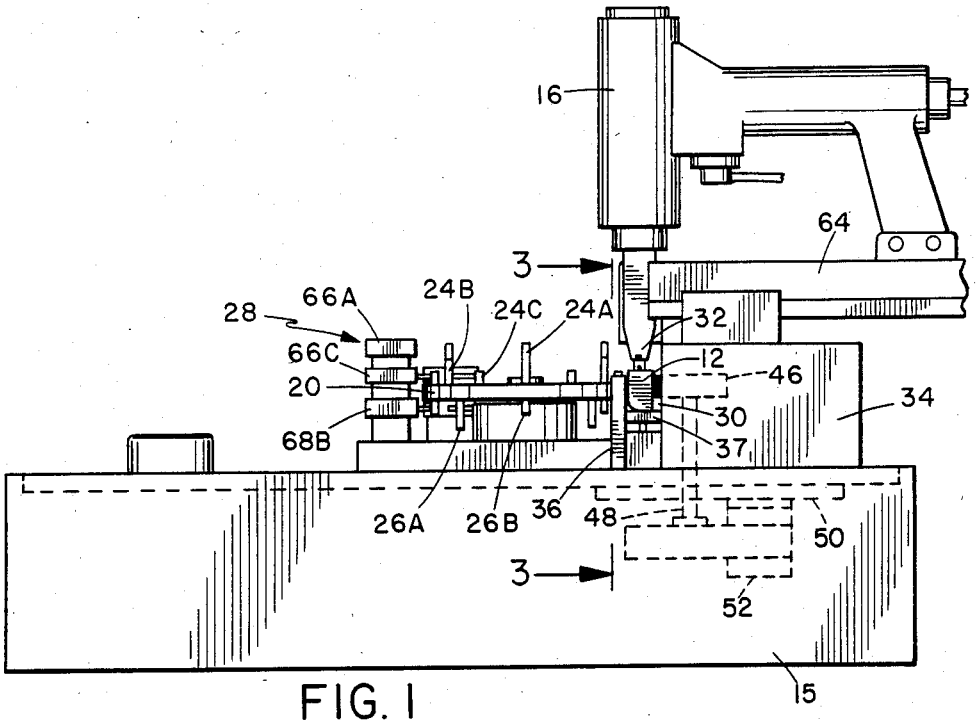
FIG. 1 is a side elevation view of a stapling machine according to a preferred embodiment of the invention.

FIGS. 1 to 5 of the drawings show a stapling machine according to a preferred embodiment of the present invention. Although the machine shown in the drawings is used to drive staples 10 at spaced intervals into a slat or rod 12, it will be clear to those in the field that the machine could be used to drive other sharp pointed objects into a rod, for example hooks, pins and the like, for various applications where it is necessary to have such objects at equally spaced intervals in a rod. In the preferred embodiment of the invention, the rod with equally spaced staples is intended for use in assembling blinds, with successive slats in the blind being hinged to the successive staples in the rod 12. It can be seen from FIG. 3 that the staples are driven into the rod so that they project upwardly a certain amount to form hinges 14.

The stapling machine includes a housing or support 15 on which are mounted a staple gun 16 or equivalent device for driving staples into the rod 12, a driving assembly 18 for moving the rod past the gun 16, and an indexing wheel 20 rotatably mounted on pin 22 in the upper face of the housing 15. A series of switch actuator pins 24, 26 are mounted on the respective opposite faces of the wheel 20 for controlling actuator for a switching assembly 28. Switching assembly 28 controls operation of the staple gun 16 as described in more detail below.

Figure 5:
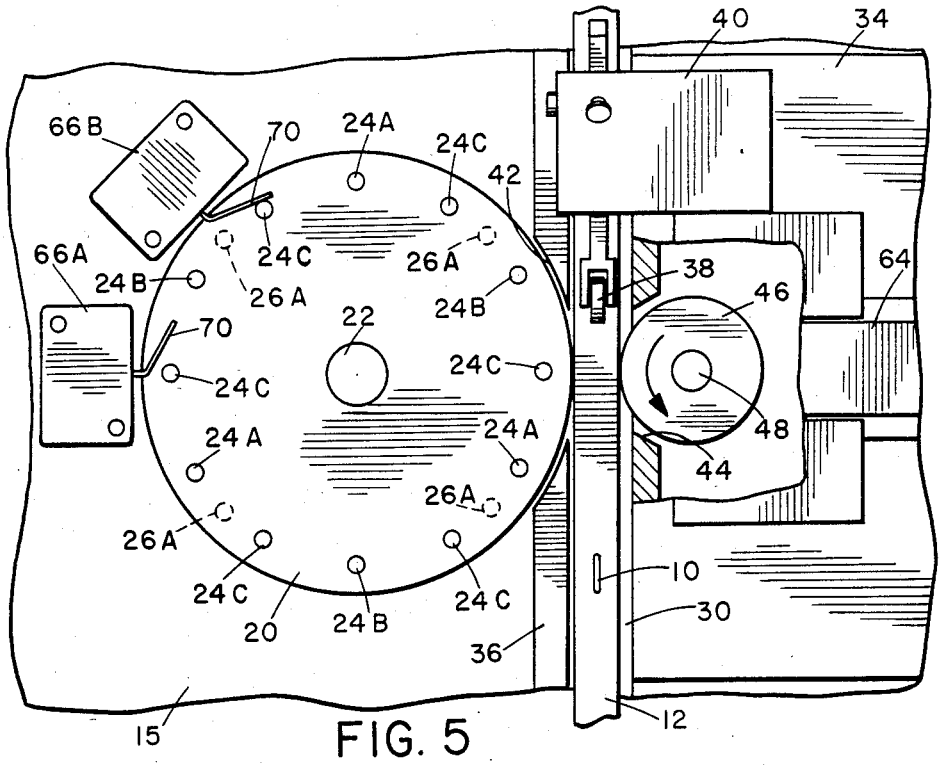
FIG. 5 is an enlarged top plan view similar to a portion of FIG. 1, showing the drive and indexing mechanism.

A guide channel 30 for guiding the rod 12 beneath the tip 32 of the staple gun 16 is defined between a mounting block 34 for the staple gun and a vertical guide plate 36 on the housing 15. This is best illustrated in FIG. 5. The rod 12 is supported above the face of the housing on an adjustable height platform 37 (see FIG. 3) mounted in the upper face of the housing 15, and a hold down roller 38 bears against the upper face of the rod to locate it against the platform 37. The roller 38 is pivotally mounted in a projection 40 from mounting block 34, and is spring loaded against the rod 12 as shown in FIG. 3.

As shown in FIG. 5, a cut-out 42 in the guide plate 36 allows the indexing wheel 20 to contact the rod 12. A similar opening 44 in the inner face of the mounting block 34 allows a drive wheel 46 of the driving assembly 18 to bear against the opposite side of the rod 12.

Figure 3:
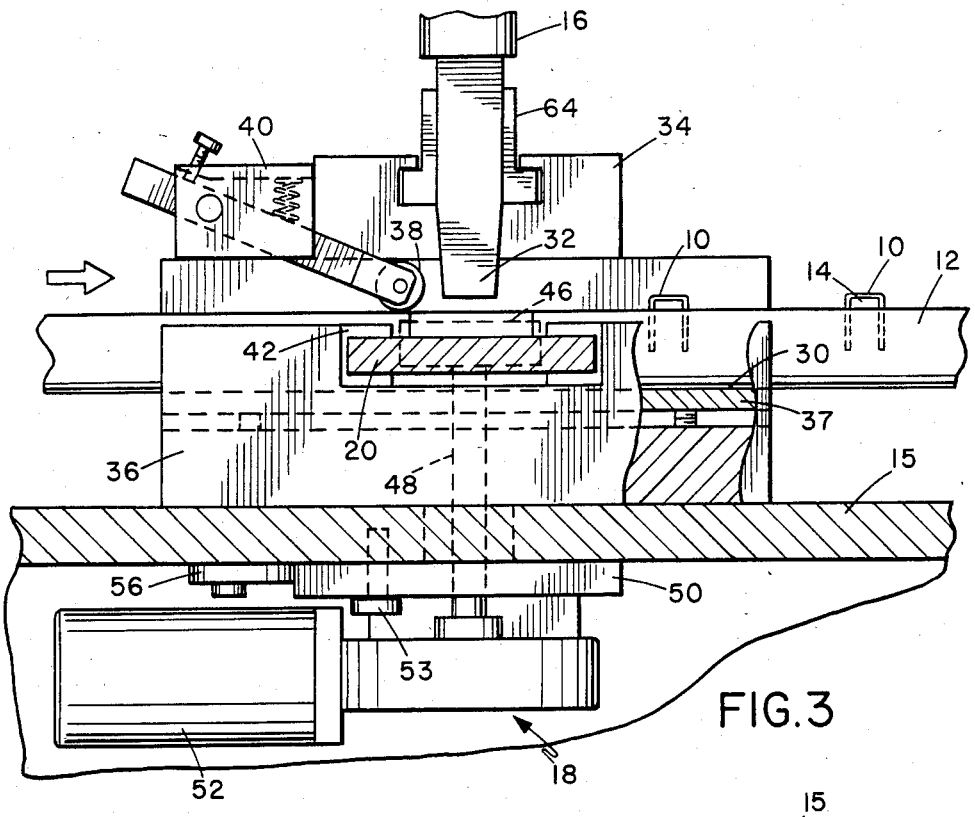
FIG. 3 is an enlarged sectional view taken on the line 3—3 of FIG. 1.
Figure 4:
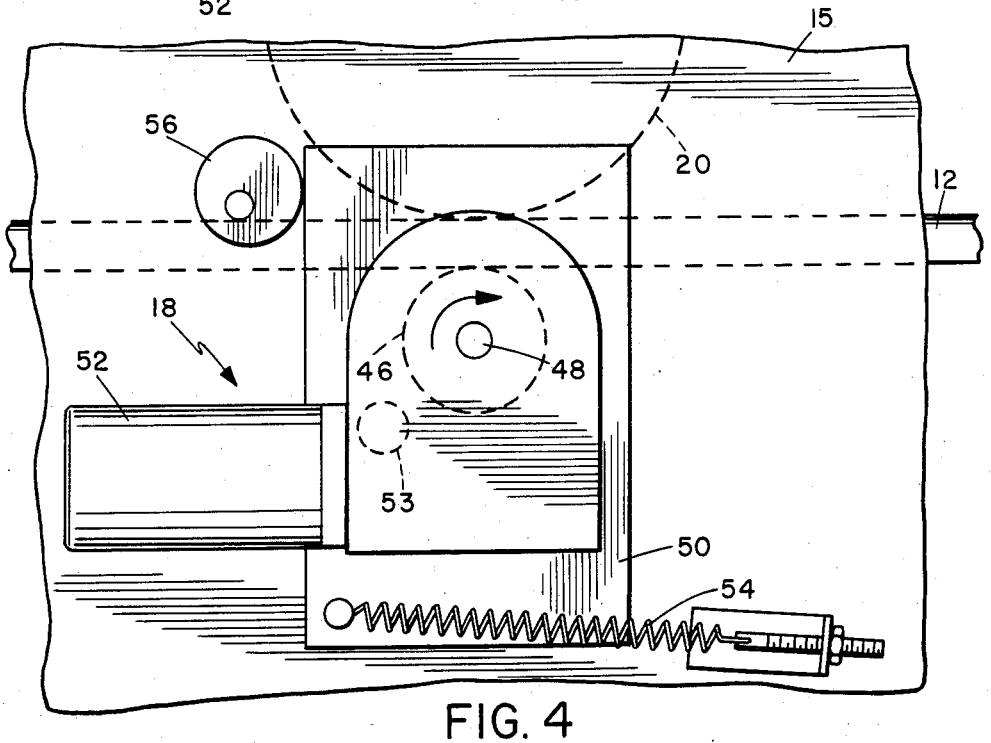
FIG. 4 is an underside view of the structure of FIG. 3.

The operation of the driving assembly can best be understood with reference to FIGS. 3 and 4. The drive wheel 46 is located in the mounting block 34 and mounted on drive shaft 48 which projects downwardly through the upper wall of the housing for rotatable mounting on a mounting plate 50. A motor 52 for driving the drive shaft 48 is also mounted on the plate 50. The plate 50 is itself pivotally mounted via pin 53 against the inner face of the upper wall of the housing, and an adjustable bias spring 54 urges the plate in a direction to force the drive wheel 46 against the side of the rod 12. An eccentric stop 56 bears against the edge of the plate 50 as shown in FIG. 4 to set the drive pressure. Thus rotation of wheel 46 will move the rod 12 along the channel 30.

Figure 6:
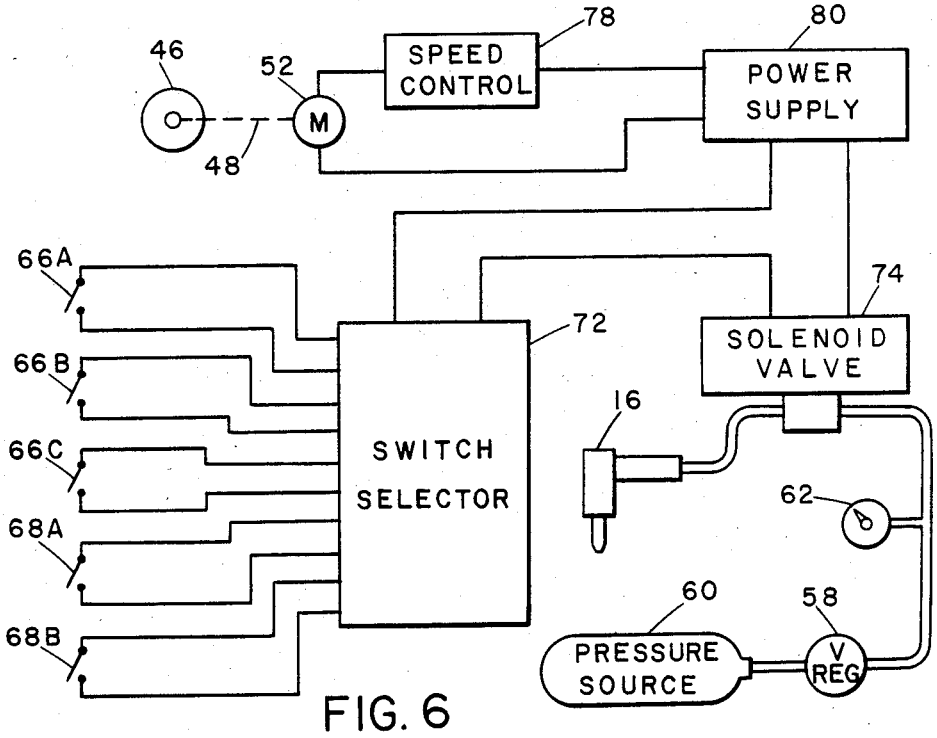
FIG. 6 is a schematic of the control and actuating system.

The staple gun 16 is mounted on the mounting block 34 and is preferably a conventional pneumatic staple gun connected via a pressure control valve 58 to a source 60 of air pressure, as indicated in FIG. 6. A pressure gauge 62 is provided for control of the pressure of air supplied to operate the gun 16, and thus the force with which staples are driven into the rod 12. The gauge 62 is set according to the material into which the staple is to be driven and the depth to which it is to be inserted. Thus the operator can control the staple gun so that staples project upwardly out of the rod to form hinges. In one typical example the rod 12 is of wood. The gun 16 includes a magazine 64 for storing staples.

The indexing wheel 20 and associated switching assembly 28 will now be described in more detail with reference to FIGS. 1 and 5. The wheel 20 will be driven to rotate by movement of the rod 12 along the guide channel 30.

The spacings between actuator pins 24 and 26 are arranged according to the desired staple spacing. The switching assembly includes upper and lower microswitches 66, 68 positioned to be actuated by the upper and lower pins 24, 26, respectively each time one of the pins contacts a spring contact 70 of the respective microswitch.

Several different staple spacings may be provided by suitable arrangement of the sets of pins 24 and 26. FIGS. 1 and 5 show one example where five different pin spacings are provided, but clearly many alternative pin arrangements are possible.

As shown in FIGS. 1 and 5, the wheel is provided with twelve equally spaced pins 24 around its upper face, so that there will be a 30 degree spacing between adjacent pins. The bottom face of the wheel has 8 pins 26 at 45 degree spacings. These are shown in dotted outline in FIG. 5, with four of the lower face pins coinciding with the position of pins on the upper face. The pins on the upper and lower faces are varying height, with microswitches arranged to be actuated by pins of one or more heights only. Thus, one of the upper face microswitches 66A (see FIG. 1) will be actuated only by the tallest pin in the upper face. The next microswitch 66B will be actuated by the tallest and next tallest pins, and the lowest microswitch 66C above the wheel is actuated by every pin projecting from the upper face of the wheel. If the different height pins on the upper face are labelled 24A, 24B and 24C as shown in FIG. 5, with A representing the tallest and C representing the shortest, it can be seen that the six pins C are provided at 60 degree spacings, the three B pins are at 120 degree spacings and the three A pins are also 120 degree spacings. Thus one of the microswitches 66A is actuated only by the tallest pins 24A, and thus only once every 120 degree rotation of the wheel. The next tallest microswitch 66B is actuated by pins 24A and 24B and thus once every 60 degree rotation of the wheel. The shortest microswitch 66C is actuated by every pin and thus once every 30 degree rotation of the wheel.

The lower face of the wheel is provided with alternating pins 26A and 26B of two different heights, with a first microswitch 68A arranged to be actuated only by the tallest pins and a second microswitch 68B arranged to be actuated by all the pins. Thus microswitch 68A will be actuated once for every 90 degree rotation of the wheel and microswitch 68B will be actuated once for every 45 degree rotation of the wheel.

In one example, the heights of pins 24A, 24B and 24C were 1.9 cms ($\frac{3}{4}$ inch), 1.3 cms ($\frac{1}{2}$ inch), and 0.64 cms ($\frac{1}{4}$ inch) respectively, and the heights of pins 26A and 26B were 1.3 cms ($\frac{1}{2}$ inch) and 0.64 cms ($\frac{1}{4}$ inch) respectively. However, these heights are only given by way of example and various other arrangements are possible. The microswitches 66A, 66B and 66C, and 68A and 68B will be positioned accordingly. As best illustrated in FIG. 1, three of the microswitches 68B, 66C and 66A may be stacked one on top of each other, adjacent the periphery of the indexing wheel. The other two microswitches, 68A and 66B, are stacked together at another position adjacent the periphery of the wheel as shown in FIG. 5. Each microswitch has its spring contact 70 projecting inwardly for contact with the respective pins.

The distance the rod 12 must travel to provide one complete 360 degree revolution of the indexing wheel is determined by the radius r of the wheel. One complete revolution of the wheel is equivalent to the rod travelling a distance of $2\pi r$. Thus the various pin spacings allow switch actuations at rod travel distances of $2\pi r/12$, $2\pi r/4$, $2\pi r/6$, $2\pi r/8$ or $2\pi r/12$. Clearly other spacings may be provided by suitable pin and microswitch configurations. An indicator or switch selector 72 (see FIG. 2) is provided for selection of the spacing between successive staples, as described in more detail below.

Thus various staple spacings can be provided by suitable arrangement of the pins and microswitches. Instead of providing a series of switch actuator pins on the indexing wheel, a series of spaced microswitches may be provided around the wheel for successive actuation by one or more switch actuators on the wheel.

The operation of the stapling machine will now be described in more detail with reference to FIG. 6, which is a schematic diagram of the control and actuating system for the machine. As shown in FIG. 6, the five microswitches 66A, 66B and 66C, 68A and 68B are each connected through switch selector 72 to a solenoid valve 74 for actuating the staple gun. The staple gun is connected to pressure source 60 via pressure control valve 58 and the pressure is indicated on gauge 62. The pressure may be manually controlled by pressure control 76 to control the air pressure supplied to the gun.

The drive wheel is driven by motor 52 with a suitable speed control 78 for controlling the speed of the rod 12. The motor and other electrical components of the machine are driven by a suitable power supply 80 which may be mounted in the housing 15.

Figure 2:
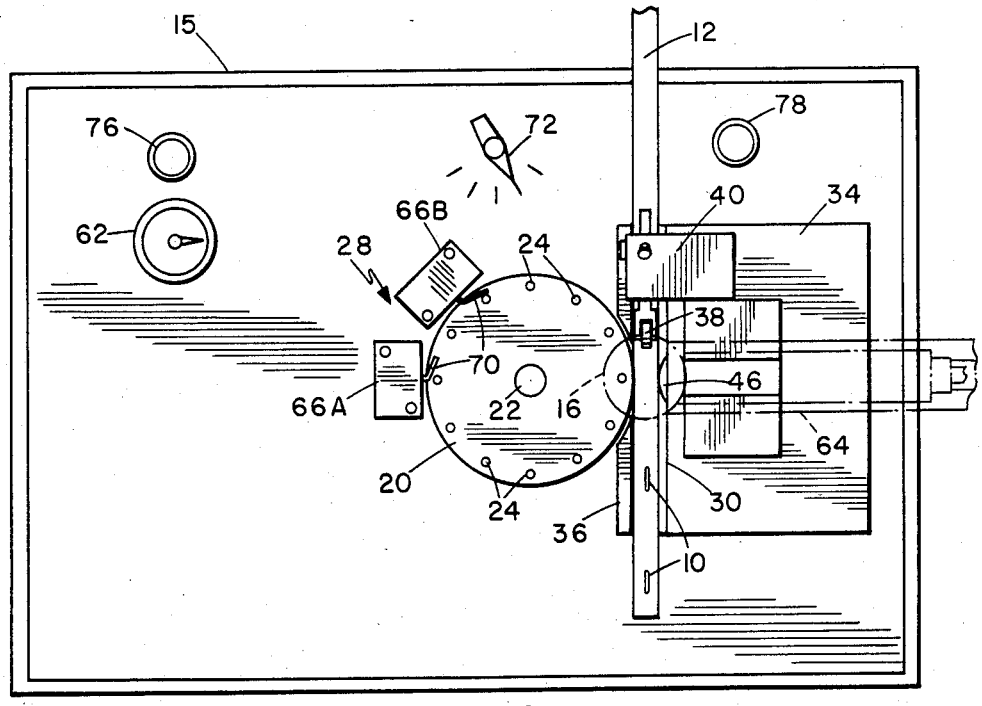
FIG. 2 is a top plan view of the machine with the staple gun indicated in broken line.

The various operator controls such as switch selector 72, motor speed control 78, and staple gun pressure control 76 are suitably mounted in the upper face of the housing 15 as shown in FIG. 2. A power switch (not shown) is also provided.

The operator will first insert a rod along the guide channel 30. The desired staple spacing is then selected on the dial of selector 72. This controls which one of the microswitches is connected to the solenoid valve 74. The motor is then switched on and driven at the chosen speed to move the rod 12 along the channel 30.

As the rod is driven along the guide channel, it will drive the indexing wheel 20 to rotate. Each time one of the pins on the indexing wheel closes the contact 70 on the selected one of the microswitches, the solenoid valve will be operated to open the air connection to staple gun 16, and a staple will be driven into the rod 12. Thus, if microswitch 66C, were selected, the staple gun would be repeatedly actuated for every 30 degree rotation of the indexing wheel, or every time the rod has travelled a distance of $2\pi r/12$. The selector switch will be graduated according to the various staple spacings provided by the respective microswitches.

Thus, staples are automatically driven into the rod 12 at substantially uniform spacings, saving a considerable amount of time over the previous methods of stapling rods manually, and producing a much more accurate end product. This is important in applications such as blind manufacture, where slats must be pivoted to wooden mounting rods at substantially equal spacings for an attractive appearance and efficient operation.

Clearly there are other applications for such a machine where objects are to be driven into a rod at equal spacings. Any sharp pointed object, such as a pin, hook or the like, could be driven into the rod 12 in a similar manner.

Any desired spacings may be provided by suitable arrangement of the indexing wheel pins and microswitches. In the embodiment described above five different spacings are provided, but clearly more or less pins for providing more or less different spacings may be used.

Although a preferred embodiment of the invention has been described above by way of example, it will be understood by those skilled in the field that modifications may be made to the disclosed embodiments which are within the scope of the invention as defined by the appended claims.

What is claimed is:

1. A machine for driving objects into a rod at spaced intervals, comprising:

object applying means for driving objects into the rod;

drive means for moving the rod in a drive path past the object applying means;

an indexing wheel mounted for rotation about an axis transverse to the drive path and positioned with its periphery adjacent the drive path to be contacted and driven to rotate by a rod moving along the drive path;

a series of switch actuating pins of at least two different heights projecting outwardly at spaced intervals from an annular ring around one axial face of the wheel;

switch means adjacent the periphery of the wheel for controlling operation of said object applying means, including a first switch positioned for contact with pins of both heights and a second switch positioned for contact with the tallest pins only, on rotation of said indexing wheel; and switch selector means for selecting either of the switches for controlling operation of the object applying means.

2. A machine for driving staples into a rod at spaced intervals to form hinges, comprising:

a staple gun for driving staples into a rod;

means for controlling the force of the staple gun to drive staples only partially into the rod with the upper part of each staple projecting upwardly to form a hinge;

drive means for moving the rod along a drive path past the staple gun;

a rotatable indexing wheel positioned adjacent said drive path with its axis of rotation transverse to said drive path for contacting a rod in the drive path to be rotated by movement of the rod;

a series of switch actuating pins of at least two different heights projecting outwardly from at least one axial face of the wheel;

a series of switches for controlling operation of the staple gun, including a switch for each different pin height positioned for contacting pins of height equal to or greater than the respective pin height on rotation of the wheel; and manually operable switch selector means for selecting which of the switches controls operation of the object applying means, each switch corresponding to a different staple spacing.

3. A machine for driving objects into a rod at spaced intervals, comprising:

object applying means for driving objects into the rod;

drive means for moving the rod past the object applying means;

a rotatable indexing wheel for contacting the rod and rotating in response to movement of the rod;

switch actuating means mounted on said indexing wheel, comprising a series of projecting pins mounted at spaced intervals around each face of said indexing wheel, the pins being of at least two different heights;

switch means for controlling operation of said object applying means to drive an object into said rod, said switch means including a switch corresponding to each different height pin on each face of the wheeel, each switch corresponding to a different staple spacing and being positioned for actuation by contact with pins of a height equal to or greater than the corresponding pin height on rotation of the wheel;

manually operable switch selector means for selecting which of the switches controls operation of the object applying means, whereby staples are driven into the rod at a spacing controlled by the spacing between pins of a height sufficient to actuate the selected switch.

4. The machine of claim 3 wherein said objects are staples and said object applying means comprises a staple gun.

5. The machine of claim 4, wherein said staple gun is controlled to drive staples into said rod so that said staples project upwardly from the rod, whereby the staples form a hinge part.

6. The machine of claim 3, wherein a first series of pins at a 30 degree spacing are provided in an annular ring on one face of the wheel and a second series of pins at a 45 degree spacing are provided in an annular ring on the opposite face of the wheel, said switch means including at least one switch located at the periphery of said wheel and projecting inwardly for contact by said first series of pins, and at least one switch located adjacent the periphery of said wheel and projecting inwardly for contact by said second series of pins as the wheel rotates.

7. The machine of claim 6 wherein said first series of pins comprise pins of three different heights and said second series of pins comprise alternating pins of two different heights, said switch means comprising a series of microswitches at heights corresponding to the respective pin heights and switch selector means for selecting any one of the microswitches for controlling operation of the object applying means.

8. The machine of claim 3 wherein said drive means comprises a drive wheel in driving contact with said rod and a motor for driving said drive wheel.

9. The machine of claim 8 including a housing, a guide channel for guiding said rod across the upper face of said housing, means for supporting said rod in said channel above the face of said housing, said drive wheel and indexing means being mounted on said upper face on opposite sides of said channel so as to contact opposite sides of said rod.

* * * * *